United States Patent [19]

Manizza

[11] 4,114,797

[45] Sep. 19, 1978

[54] TRAY TYPE CONTAINER

[75] Inventor: Guelfo A. Manizza, Blauvelt, N.Y.

[73] Assignee: Federal Paper Board Co., Inc., Montvale, N.J.

[21] Appl. No.: 836,309

[22] Filed: Sep. 26, 1977

[51] Int. Cl.[2] ..... B65D 5/24; F65D 5/22

[52] U.S. Cl. ..... 229/31 R; 229/31 FS

[58] Field of Search ..... 229/31 FS, 31 R, 34 A, 229/34 B

[56] References Cited

U.S. PATENT DOCUMENTS

| | | | |
|---|---|---|---|
| 1,865,635 | 7/1932 | Klein | 229/31 FS |
| 2,367,410 | 1/1945 | Lighter | 229/31 R |
| 3,008,626 | 11/1961 | Lawrence | 229/31 FS |
| 3,623,650 | 11/1971 | Watts | 229/31 R |
| 3,883,067 | 5/1975 | McGlynn et al. | 229/31 FS |

FOREIGN PATENT DOCUMENTS

| | | | |
|---|---|---|---|
| 1,158,442 | 11/1963 | Fed. Rep. of Germany | 229/31 FS |

*Primary Examiner*—Davis T.. Moorhead

*Attorney, Agent, or Firm*—Guy A. Greenawalt

[57] ABSTRACT

A tray-type container, particularly adapted for bakery products is disclosed which is formed with a single blank of paperboard and which comprises, when set up, a bottom wall forming panel with hingedly connected sidewall forming panels having narrow reinforcing flanges extending, in hinged relation outwardly along the top edges, the sidewall panels being held in upstanding relation to the bottom wall panel by integral web members connecting adjoining sidewall ends and folded so as to lie along an end margin of one of the connected sidewalls with an upwardly projecting locking tab on the top edge engaged in a cooperating locking slit cut on the hinge line between the one sidewall and its associated reinforcing flange.

2 Claims, 6 Drawing Figures

FIG. 1
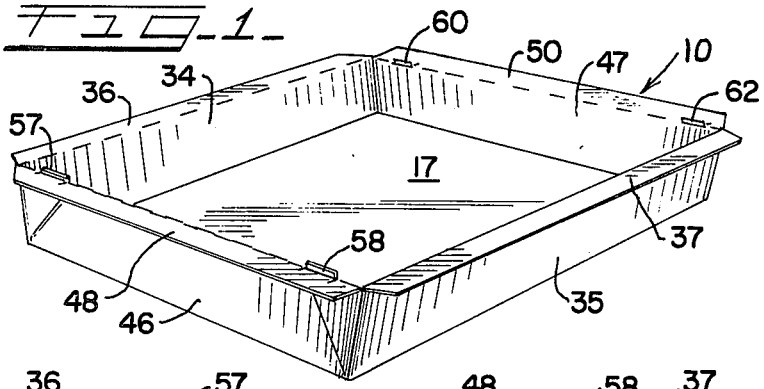
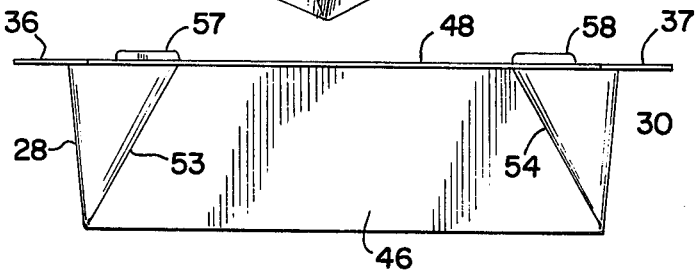
FIG. 2
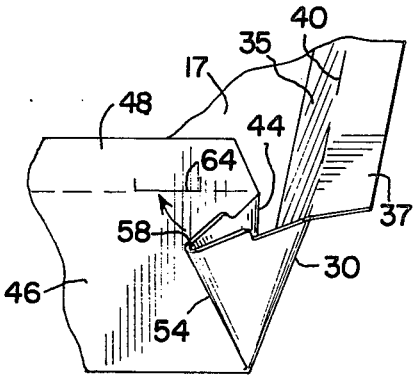
FIG. 5
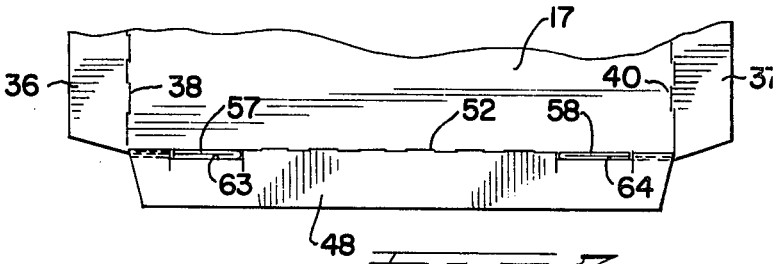
FIG. 3
FIG. 4
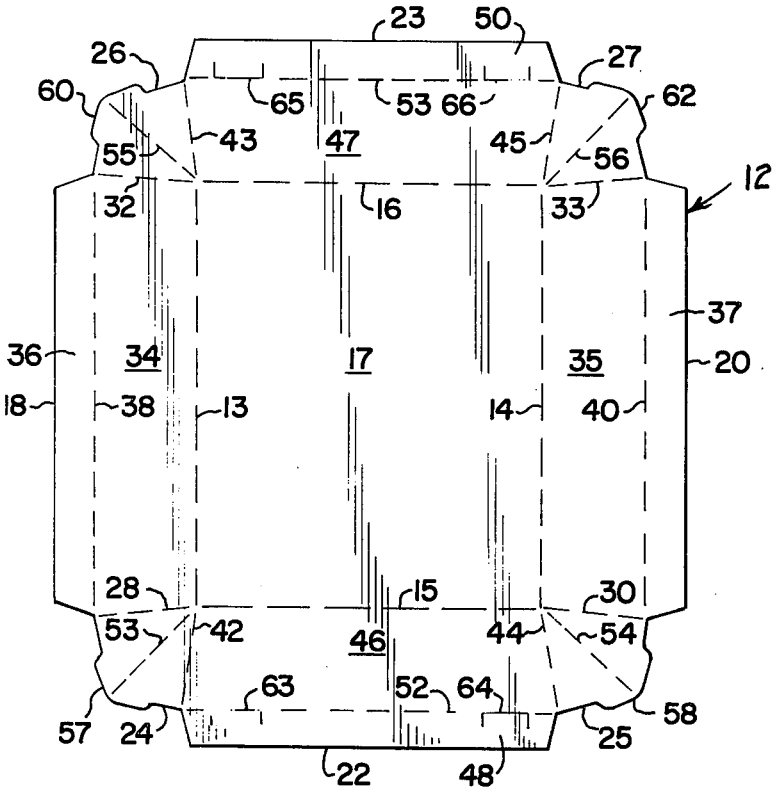
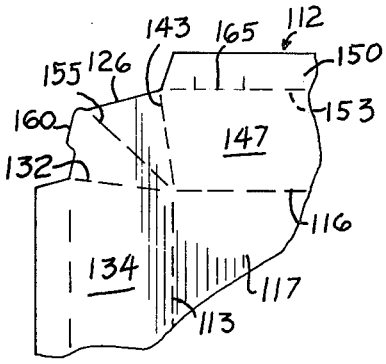
FIG. 6

TRAY TYPE CONTAINER

This invention relates to containers and is more particularly concerned with improvements in packaging containers which are adapted to be formed of foldable sheet material of a character which enables the containers to be used for the processing and marketing of products which may be in a flowable state, when placed in the containers initially, such as, bakery products.

In the bakery industry there is a need for tray-type containers in which bakery products can be confined while they are processed in an oven. Products, such as cakes, pastry and the like, are generally, in a flowable state initially, that is, in a liquid or semi-liquid condition, so that, a bakery requirement is that the container be of such a character that it will be leak-proof when filled with a liquid material and capable of withstanding baking temperatures. For some products it is desirable that the container be formed of a material which is not only capable of withstanding oven temperatures during the baking process without appreciable damage from the heat but which is also of a character suitable for marketing the baked product without removal from the container in which it is baked. For such products, containers or baking trays have been designed which are adapted to be fabricated of thin metal sheet or relatively stiff metal foil which can be pressed or shaped to the desired form and which can serve as part of the final package in which the product is marketed. Generally containers of this type have been relatively expensive. While some efforts have been made to provide containers for such purposes, which are less expensive so as to compete economically with the metal or metal foil, they have not proven successful for various reasons.

A general object of the present invention is to provide an improved container of the tray-type which is suitable for use in the processing and packaging of bakery products, or the like, and which may be formed of paperboard or similar, foldable sheet material.

A more specific object of the invention is to provide an improved container for packaging bakery products, or the like, which may be formed from a cut and creased blank of foldable sheet material, such as, a treated paperboard which will withstand baking temperatures without damage and which may serve as a satisfactory package for marketing the product.

Another object of the invention is to provide a container which is suitable for processing and marketing bakery products, or the like, which is adapted to be formed from a sheet of paperboard or a paperboard laminate having heat resistant properties and which is fabricated so as to be supplied as a flat blank with provision for setting it up in the form of a leak-proof tray without the use of an adhesive or similar fastening means and on machinery of conventional design.

A further object of the invention is to provide a container for use in processing and packaging bakery products, or other products, which may be in a flowable state when placed in the container and which is adapted to be formed into a tray from a flat blank of foldable sheet material, such as paperboard, which is cut and scored to provide a bottom wall and associated sidewalls with foldable corner connecting web members having locking elements arranged to be engaged in cooperating locking slot forming means at the top edges of the sidewalls when the container is set up for use.

To this end there is disclosed and claimed herein a tray-type container formed from a single blank of paperboard, or similar foldable sheet material, which is cut and scored to provide a bottom wall forming panel and associated vertical sidewall panels with hinged flange formations at their top edges and integral corner connecting webs which are adapted to fold upon themselves and means on the webs and flange formations which interengage for holding the webs in corner connecting relation.

The aforesaid objects and other objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

In the drawings:

FIG. 1 is a perspective view of a tray-type container which embodies therein the principal features of the invention;

FIG. 2 is an end view of the container of FIG. 1;

FIG. 3 is a partial plan view showing one end of the container;

FIG. 4 is a plan view of a paperboard blank cut and scored preparatory to forming the container of FIG. 1;

FIG. 5 is a fragmentary perspective view illustrating the manner in which the sidewall corner connecting web member is folded and locked in position; and FIG. 6 is a fragmentary view showing one corner of a blank which illustrates a modified form of the corner connecting web locking arrangement.

Referring to the drawings, there is illustrated a tray-type container or carton 10 which is particularly adapted for use in the preparation and marketing of bakery products, or the like, and a cut and scored blank of flexible paperboard or similar foldable sheet material for fabricating the same, which embodies the principal features of the invention. It will be understood that the principles of the invention may be otherwise applied and that the following description of the container, as shown in the drawings, is for the purpose of setting forth the form of the invention which is presently preferred.

The tray 10 which is illustrated in FIGS. 1, 2, and 3 is formed from the cut and scored blank 12 which is shown in FIG. 4. The blank 12 is prepared from paperboard which is preferably coated or laminated with a suitable material to render it more resistant to damage when subject to high temperatures, such as, baking oven temperatures. The paperboard stock is of a gauge which will provide a desired degree of stiffness so that it will substantially retain its normal shape when filled with the product which is to be processed. In the form shown the paperboard stock material is provided with a coating of a material which will increase its resistance to absorption of heat to the degree desired for withstanding baking oven temperatures. A suitable treatment of the paperboard stock to form the laminated blank is set forth is U.S. Pat. No. 3,904,104, granted Sept. 9, 1976 to William Paul Kane.

The blank 12 is formed from a generally rectangular sheet of the material and is cut and scored or creased, so that, as shown in FIG. 4, it is symmetrical about longitudinal and transverse center lines. Parallel, longitudinally spaced, hinge forming score or crease lines 13, 14 and parallel, transversely spaced, hinge forming score or crease lines 15, 16 divide the blank into a bottom wall forming center panel 17, sidewall forming panel portions 18 and 20, and end wall forming panel portions 22 and 23, with side and end wall corner connecting web portions 24, 25, 26 and 27, being formed at the four corners of the blank. The transverse score lines 15 and 16 are extended at their opposite ends on lines 28, 30 and 32, 33, respectively, on a slight angle or inclination in the direction of the opposite ends of the blank and define the opposite ends of the sidewall panels 34 and 35, with these panels having narrow flange forming panel portions 36, 37 extending along the free outer magins which are divided therefrom by score lines 38 and 40, the latter being parallel with and spaced outwardly of the score lines 13 and 14, respectively. The longitudinal score lines 13 and 14 are extended at their opposite ends on lines 42, 43 and 44, 45 which are on a slight angle or inclination in the direction of the opposite sides of the blank and which define the ends of end wall panels 46 and 47, with the latter having narrow flange forming panel portions 48, 50 divided therefrom by score lines 52, 53 which are parallel with and spaced outwardly of the score lines 15 and 16, respectively. The corner connecting web panels 24, 25, 26, and 27 are each divided into a pair of equal panels by a center fold forming score line 53, 54, 55 and 56 and each of these web panels has formed on its outer edge a locking tab formation 57, 58, 60 and 62 which is divided by the associated fold line 53, 54, 55, and 56 into two equal parts. The end wall edge reinforcing and stiffening panels 48 and 50 have U-shaped locking or latching slits cut therein at 63, 64 and 65, 66, respectively, which are cut the proper size and properly spaced from opposite ends of the panels 48, 50 for receiving in interengaging relation the locking or latching tabs 57, 58, 60 and 62 when the corner connecting webs 24, 25 26, and 27, including the associated locking tabs, are folded and moved into closed position against the end margins of the end wall panels 46 and 47 in setting up the container.

The paperboard blanks may be printed if desired and furnished in flat condition for subsequent erection by relatively simple machinery. The end walls 46, 47 are hinged to upstanding position followed by hinging of sidewalls 34, 35 to an upright position and folding of the corner connecting webs 24, 25, 26 and 27 upon the score lines 53, 54, 55 and 56 and against the outside faces of the end wall panels 46 and 47 which positions the locking tabs for engagement in the cooperating locking slits 63, 64, 65 and 66 upon outward hinging of the edge stiffening panels 48 and 50.

A modified corner connecting web arrangement is illustrated in FIG. 6 which shows a corner portion of a modified blank 112 which is cut and scored to provide the modified construction. The adjacent ends of the side and end walls 134 and 147 are connected by an integral connecting web member 126 which is defined by score lines 132 and 143 extending outboard in diverging relation from the intersection of the score lines 113 and 116 which define one corner of the bottom wall forming panel 117. The connecting web 126 is divided by a hinge forming center score line 155 and the one triangular panel resulting from the division carries at its outermost edge a locking tab 160 which is approximately half size relative to the size of locking tab 60 in FIG. 4. The tab 160 is adapted for insertion in the aperture resulting from the slit 165 in the hinge line 153 for the flange forming strip 150 on the end wall forming panel 147. The tab 160 is on the outermost edge of the half of the corner connecting web 126 which becomes the outermost triangular web panel when the web 126 is folded upon the hinge line 155 and against the outside face of the end wall panel 147 (FIG. 5) in setting up the tray with the corner locking tab inserted in the slit 165. This provides maximum rigidity and security against separation of the web panels.

In both forms of the tray which are illustrated the score lines defining the hinge lines between the corner connecting webs and the associated side and end wall panels are angled relative to the hinge lines connecting the side and end wall panels with the bottom wall panel so that the side and end walls slant outwardly in the set up tray. The angle of inclination may be varied so as to eliminate or change the wall slant.

While in both forms of the tray illustrated the outwardly hinged top edge flange extends along the entire top of each sidewall panel of the tray only portions of the flange in which the locking slits are cut is necessary for effecting the locking at the corners and other portions of the flange structure may be omitted if desired. The slits, as illustrated, are cut in the hinge line with short end portions extending into the edge flange which insures that the full depth of the tray is leakproof. The placing of the slits so that the ends extend into the sidewall can provide an effective locking arrangement with the loss of some leakproof depth.

What is claimed is:

1. A tray type container comprising a bottom wall forming panel, upstanding sidewall forming panels integrally hinged to the peripheral edges of the bottom wall forming panel and integral connecting corner web members joining adjacent ends of adjoining sidewall forming panels, said sidewall forming panels having narrow top flange forming panel members extending adjacent the ends of the adjoining sidewall forming panels which are adapted to be hinged into a plane generally normal to the plane of an associated sidewall forming panel, said corner connecting web members being folded so as to lie in engagement with the end marginal portions of an associated sidewall forming panel and having a locking tab extending outwardly of the outermost edge thereof which is engaged in a cooperating locking aperture disposed adjacent the hinge connection of said associated sidewall forming panel and the top flange forming member which is hinged thereto, said corner connecting web members being divided into two hingedly connected generally triangular panel portions which are folded so as to be positioned in overlying relation and disposed along the outermost face of said associated sidewall forming panel, and said locking tab of each corner connecting web member bridging the fold line of said triangular panel portions of said web member.

2. A blank of paperboard or similar foldable sheet material which is cut and scored for forming a tray-type container of relatively shallow depth, said blank being divided by pairs of oppositely disposed spaced, parallel hinge score lines which are offset inwardly of the blank side edges into a bottom wall forming panel and sidewall forming panel portions, which extend about the periphery of said bottom wall panel and which are adapted to be hinged to upstanding position relative to the bottom wall panel in setting up the tray container, and corner web forming portions extending in integral relation between adjacent ends of said sidewall forming panel portions, said corner web forming portions each being divided by hinge score lines into two generally triangular panel portions which are adapted to be folded when the carton is set up so as to be positioned in overlying relation and to be disposed along the face of an associated sidewall panel to which it is integrally connected, said corner web forming portions each having an integral locking tab extending outwardly of the outermost edge thereof and bridging the dividing hinge score line, which locking tab is adapted for locking the corner web portion in position when it is folded, and said sidewall panel against which the associated corner web portion is adapted to be disposed having a narrow flange forming strip portion extending along the outer edge thereof and divided therefrom by a hinge score line enabling said flange forming strip portion to be hinged to a plane generally normal to the plane of the sidewall panel and having a locking slit cut therein at the hinge line which is located so as to engage in locking relation therein said locking tab when the container is set up.

* * * * *